United States Patent [19]

Uchida

[11] 4,250,692

[45] Feb. 17, 1981

[54] APPARATUS FOR BINDING PAPER SHEETS

[75] Inventor: Isamu Uchida, Tokyo, Japan

[73] Assignee: Laurel Bank Machine Co., Ltd., Tokyo, Japan

[21] Appl. No.: 972,209

[22] Filed: Dec. 22, 1978

[51] Int. Cl.[3] ..... B65B 13/20; B65B 13/32; B65B 27/08

[52] U.S. Cl. ..... 53/528; 53/586; 100/3; 100/6; 100/33 PB; 156/468; 156/502; 156/515; 156/522

[58] Field of Search ..... 100/3, 17, 18, 33 PB, 100/6, 24; 53/548, 553; 156/213, 251, 468, 502, 515

[56] References Cited

U.S. PATENT DOCUMENTS

| | | | |
|---|---|---|---|
| 2,037,039 | 4/1936 | Ott | 100/18 |
| 2,632,381 | 3/1953 | Buckland | 100/3 |
| 3,587,448 | 6/1971 | Hemphill et al. | 100/17 |
| 3,869,844 | 3/1975 | Edouard | 53/548 X |
| 3,946,539 | 3/1976 | Noack | 53/586 |
| 4,033,249 | 7/1977 | Schmalz et al. | 100/3 |

FOREIGN PATENT DOCUMENTS

| | | |
|---|---|---|
| 45-12959 | of 1970 | Japan . |
| 53-3707 | of 1978 | Japan . |

*Primary Examiner*—Michael G. Wityshyn
*Attorney, Agent, or Firm*—Fleit & Jacobson

[57] ABSTRACT

An apparatus for binding paper sheets, characterized in that a pair of confronting gripping plates are disposed above a paper sheet supporting plate, a groove for a tape and a groove for a tape application lever are formed on the inner faces of the gripping plates, respectively, paper sheets gripped by both the gripping plates are moved toward the side of the tape application lever to bend a binding tape inserted in the tape groove of the gripping plate in the direction of the thickness of the paper sheets, the binding tape is pressed by the tape application lever to insert the binding tape into the groove for application lever to surround the paper sheets, and the surrounding end of the tape is bonded to the other side of the tape to effect binding of the paper sheets.

7 Claims, 7 Drawing Figures

APPARATUS FOR BINDING PAPER SHEETS

BACKGROUND OF THE INVENTION

The present invention relates to an apparatus for binding paper sheets, particularly an apparatus which can bind a variety of paper sheets such as bills irrespectively of the size and thickness of the paper sheets.

In the conventional apparatus for binding paper sheets, an adjusting zone is controlled and adjusted according to the size and thickness of the paper sheets to be bound. The need for an adjusting zone makes the structure of this binding apparatus complicated and, moreover, the adjusting operation is very troublesome. Accordingly, the conventional apparatus is defective in that the efficiency of the paper sheet binding operation is very low.

SUMMARY OF THE INVENTION

The present invention has been perfected as a result of investigations made with a view to eliminating these defects encountered in the conventional apparatus. It is therefore a primary object of the present invention to provide an apparatus for binding paper sheets, in which a variety of paper sheets can be bound irrespective of their size and thickness and the operation efficiency is remarkably increased by eliminating time-consuming labor.

BRIEF DESCRIPTION OF THE DRAWINGS

The present invention will be explained with reference to the accompanying drawings in which.

DETAILED DESCRIPTION OF THE PREFERRED EMBODIMENTS OF THE INVENTION

Figure 1:
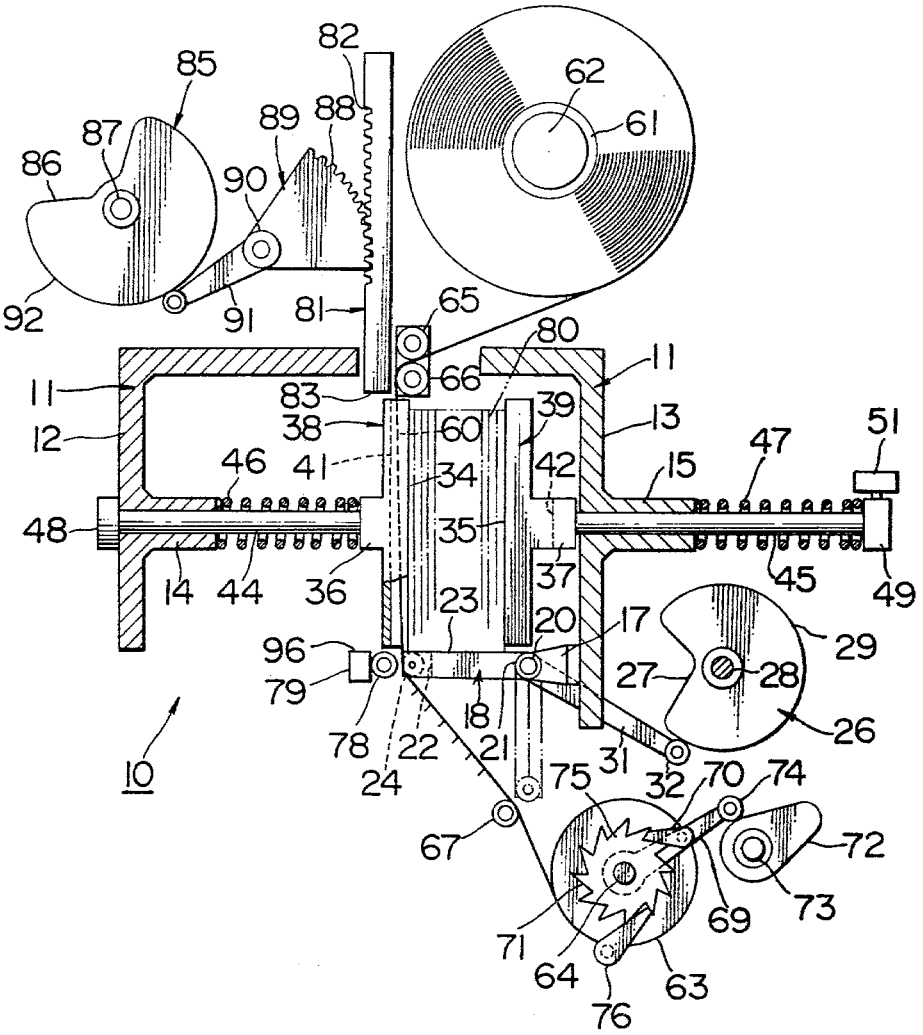
FIG. 1 is a partially cut-out longitudinal sectional side view of the apparatus according to the present invention.
Figure 2:
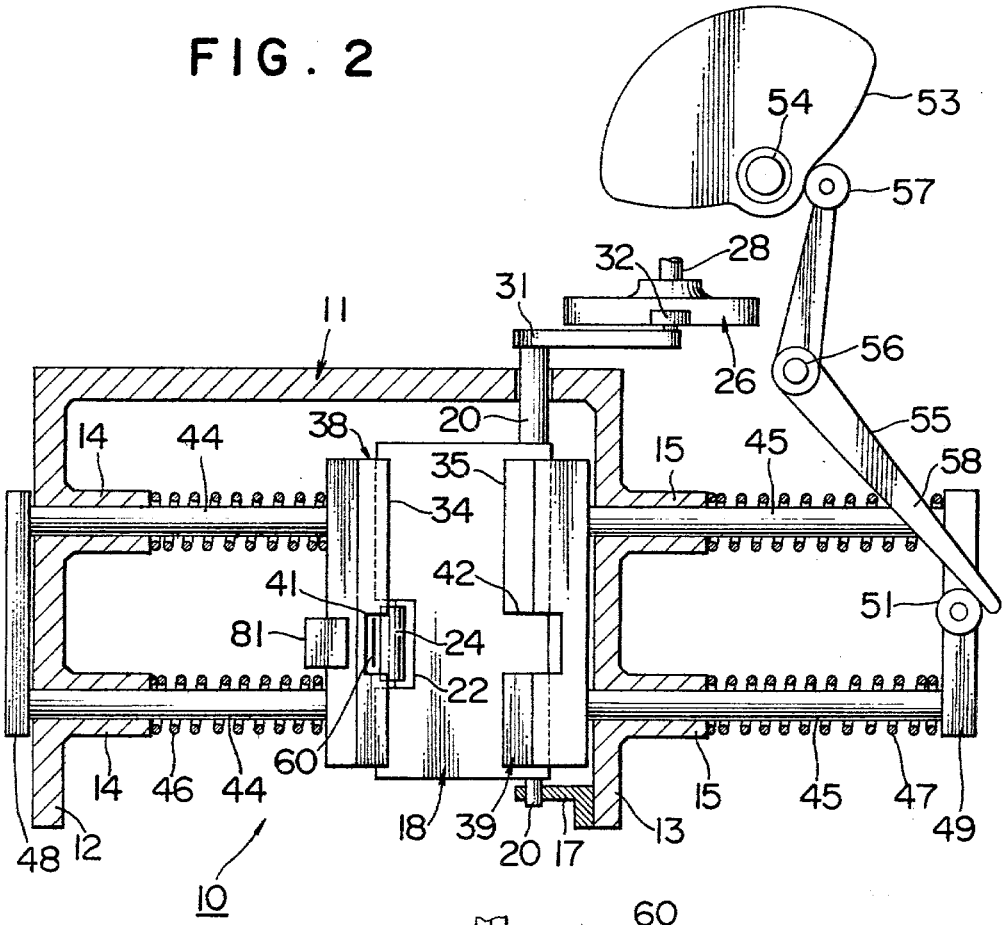
FIG. 2 is a transverse cross-sectional plan view.

Reference numerals 10 and 11 represent a machine body and a guide frame, respectively. This guide frame 11 is a frame member having vertical plates 12 and 13 confronting each other with a predetermined interval therebetween, and is fixed to the machine body 10. Bosses 14 and 15 are vertically disposed substantially at the centers of the vertical plates 12 and 13. A bearing 17 is fixed to the lower portion of one vertical plate 13. A paper sheet supporting plate 18 is a substantially rectangular plate rotatably supported by the bearing 17 through a shaft 20 fixed to the side of the base end 21 of the supporting plate 18. A groove 22 is formed substantially at the center of the side of the free end 23 of the supporting plate 18, and a roller 24 is pivoted in the groove 22. A cam 26 consisting of a disc provided with a mountain-shaped recess 27 at a portion of the peripheral face thereof is supported on the machine body 10 through a shaft 28, so that it can freely turn in the vertical direction. The top end 32 of an engaging lever 31 fixed and connected to the shaft 20 is engaged with a cam face 29 of the cam 26. When the cam 26 is turned and the top end 32 of the engaging lever 31 engages with the recess 27, the paper sheet supporting plate 18 is turned from the horizontal position to the depending position and is then returned to the horizontal position. The arrangement is such that this operation is conducted intermittently. Disposed above paper supporting plate 18 are paper sheet gripping surfaces 34 and 35 having planar faces confronting each other oriented at right angles to the direction extending from the side of the base end 21 to the side of the free end 23 of the supporting plate 18 and are formed on gripping plates 38 and 39 having a T-shaped side face. On the faces of the gripping plates 38 and 39 opposite to the paper sheet gripping surfaces 34 and 35 are formed projections 36 and 37, respectively. Substantially at the center of the paper sheet supporting surface 34 of the gripping plate 38 on the side of said free end 23 is formed a tape groove 41 extending from the upper end to the lower end. A groove 42 for a tape application lever is disposed on the paper sheet gripping face 35 and projection 37 of the gripping plate 38 on the side of said base end 21 so that the groove 42 confronts the tape groove 41. Guide rods 44 and 45 are fixed to the projections 36 and 37 located on the sides opposite to the paper sheet gripping surfaces 34 and 35 in the gripping plates 38 and 39, in directions orthogonal to the paper sheet gripping surfaces 34 and 35. Each guide rod 44 fixed to the projection 36 is inserted through a spring 46 interposed between the boss 14 and the projection 36 and is slidably fitted in the boss 14. Ends of the guide rods 44 are connected through a bar 48. Each guide rod 45 fixed to the projection 37 is fitted in the boss 15 of the vertical plate 13, and ends of the guide rods 45 are connected through a bar 49. A spring 47 fitted over the guide rod 45 is interposed between the boss 15 and the bar 49. An engaging member 51 having a disc-like shape is fixed to the upper portion of the center of the bar 49. A fan-shaped cam 53 having an arcuate peripheral surface is attached to the machine body 10 rotatably in the horizontal direction through a longitudinal shaft 54 inserted through the pivot point of the cam 53. A lever 55 is pivoted on the machine body 10 rotatably in the horizontal direction through a longitudinal shaft 56 fitted in the bent portion of a dogleg lever 55. One end 57 of the lever 55 is engaged with the peripheral face of the cam 53 and the other end 58 is engaged with the above-mentioned engaging member 51. When the cam 53 is turned, the gripping plate 39 is caused to slide from the side of the base end 21 of the paper sheet supporting plate 18 to the side of the top end 23 through the lever 55, engaging member 51, bar 49, spring 47 and guide rod 45. When the lever 55 is returned to the original position, the gripping plate 39 is returned toward the original position by the restoring force of the spring 47. A winding drum 61 of a binding tape 60 is rotatably supported on the machine body 10 through a shaft 62 above the vertical plate 13 of the guide 11. A drum 63 for taking up the binding tape 60 is rotatably supported on the machine body 10 through a shaft 64 beneath the vertical plate 13. At a position just below the roller 24 when the paper sheet supporting plate 18 is in the horizontal state, upper and lower rollers 65 and 66 are pivoted on the machine body 10 in parallel to the roller 24 and in the vicinity of the winding drum 61 above the gripping plate 38. The binding tape 60 wound on the drum 61 is taken out, passed between the rollers 65 and 66 and inserted into the tape groove 41 of the gripping plate 38 so that it can freely run through the groove 41. Then, the binding tape is engaged with the roller 24 and wound on the take-up drum 63 and stretched through a tension pulley 67 disposed at an intermediate portion between the roller 24 and the take-up drum 63. Accordingly, the binding tape 60 is engaged with the rollers 66 and 24 above the gripping plate 38 or below the paper sheet supporting plate 18 and is stretched toward the groove 42 for the tape application lever. A lever 69 is fitted to a shaft 64 integrally fixed to the take up drum 63 so that it can rotate with respect to the shaft 64, and a short pawl lever 70 is rotatably pivoted at the center of lever 69. A ratchet wheel 71 is integrally fixed to the shaft 64 on the outside of the lever 69. A shaft 73 is inserted through the central part of a large-diameter portion of a substantially egg-shaped plate cam 72. The cam 73 is rotatably pivoted on the machine body 10 and the top end 74 of the lever 69 is engaged with the peripheral face of the cam 72. The top end portion of the claw lever 70 is engaged with the claw portion 75 of the ratchet wheel 71 at the same time. A stopper 76 is pivoted on the machine body 10 below the ratchet wheel 71 and the top end portion of the stopper 76 is engaged with the claw portion 75 of the ratchet wheel 71.

The stopper 76 is urged by a spring (not shown) so that the top end portion of the stopper 76 is urged toward the center of the ratchet wheel 71 at all times.

In the above arrangement, when the cam 72 is rotated, the ratchet wheel 71 and take-up drum 63 are intermittently rotated by predetermined angles in the counterclockwise direction in FIG. 1 so that the binding tape 60 is intermittently wound on the take-up drum 63 by predetermined quantities. The stopper 76 functions to prevent the ratchet wheel 71 and winding drum 63 from rotating in the reverse direction. Another roller 78 is pivoted on the machine body 10 in the vicinity of and in parallel to the roller 24 when the paper sheet supporting plate 18 is horizontally disposed, and at the same height as that of the roller 24 at the above position. A receiving member 79 having a horizontal planar top face for adhesion of the binding tape 60 is mounted in the vicinity of roller 78 at the same height as that of the outside of the roller 78. The receiving member 79 is arranged so that when the gripping plate 39 slides and arrives at a position above the receiving member 79, the receiving member 79 is located just below the groove 42 for the tape application lever. A known device (not shown) for heating and fusion-bonding the binding tape, for example, a high frequency induction heating device, is mounted on the receiving member 79.

Figure 5:
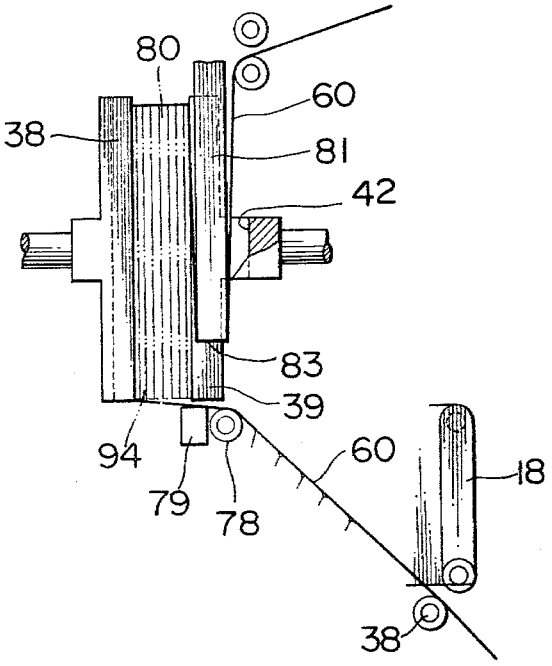
FIG. 5 is a side view showing elements in the state where the binding tape is applied around the paper sheets.

As shown in FIG. 1, a tape application lever 81 for applying the binding tape 60 around paper sheets 80 is vertically and movably mounted on the left side of the rollers 65 and 66 in the vicinity thereof through a guide (not shown). This tape application lever 81 consists of a square column on one side of which a rack 82 extending in the vertical direction is provided. Lever 81 is arranged so that, when brought down, the lever end surface 83 thereof contacts the receiving member 79 provided with the known heating device in a manner described hereinafter. A disc-like cam 85 having a mountain-shaped recess 86 formed on a part of the periphery thereof is vertically and rotatably mounted on the machine body 10 through a shaft 87. A toothed portion 88 to be meshed with the rack 82 is formed on the arcuate portion of a fan-shaped gear 89, and a shaft 90 is inserted through the pivot point of the gear 89. Shaft 90 supports the fan-shaped gear 89 on the machine body 10 so that the gear can rotate in the vertical direction. A lever member 91 is integrally fixed to the side end portion of the fan-shaped gear 89 in the direction of the extension of the radius connecting the center of the above-mentioned arcuate face portion to the center of the shaft 90. The top end portion of the lever member 91 is engaged with the periphery 92 of the cam 85 and the toothed portion 88 meshes with the above-mentioned rack 82. When the gripping plate 39 is moved to above the receiving member 79, the tape application lever 81 is brought down from above the groove 42 by rotation of the cam 85 through the lever member 91 and fan-shaped gear 89 and is fitted in said groove 42. When the lever 81 is brought down further, as shown in FIG. 5, approximately ½ of the lower end face 83 of the tape application lever 81 comes into contact with approximately ½ of the top end face of the receiving member 79 on the side of the roller 78. After a predetermined time interval, the tape application lever 81 is lifted up and restored to the original position. This operation is carried out periodically in cooperation with the sliding movement of the gripping plate 39.

Figure 3:
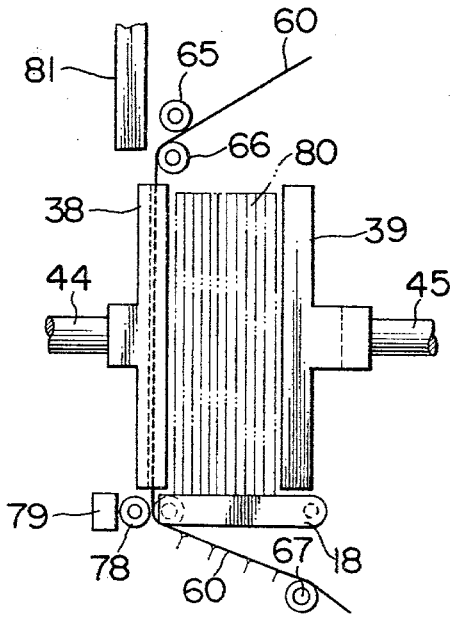
FIG. 3 is a side view showing the main elements in the state where paper sheets are supported on the paper sheet supporting plate between the gripping plates.
Figure 4:
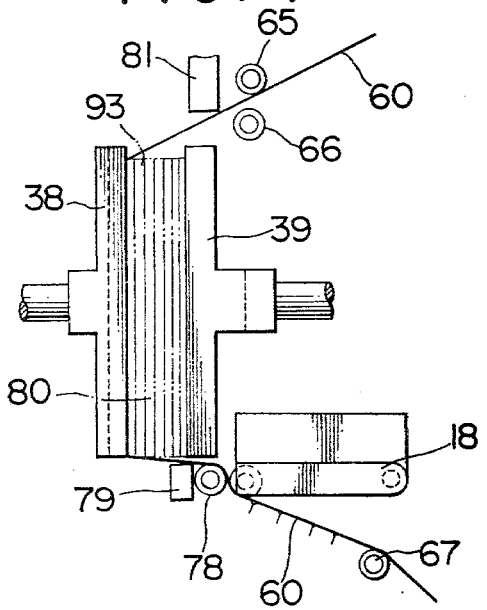
FIG. 4 is a side view showing the main elements in the state where the gripping plates are moved while the paper sheets are gripped therebetween.
Figure 6:
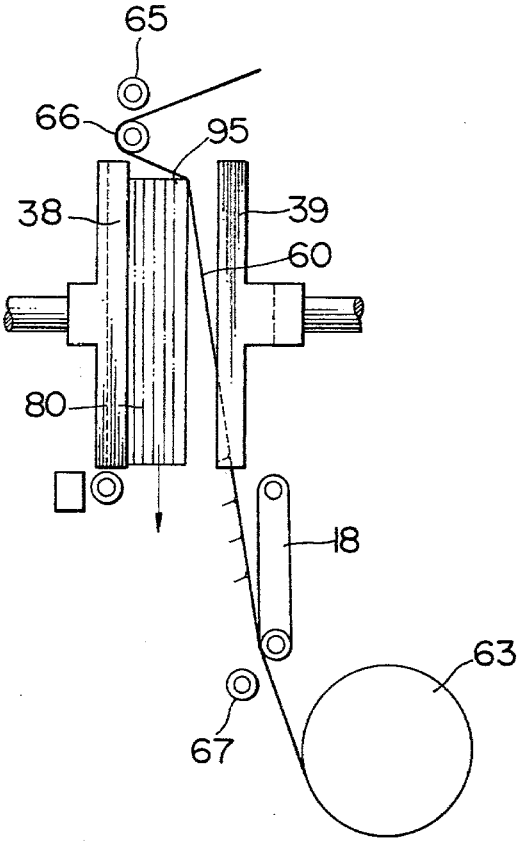
FIG. 6 is a side view showing the main elements in the state where the bound paper sheets are about to fall.
Figure 7:
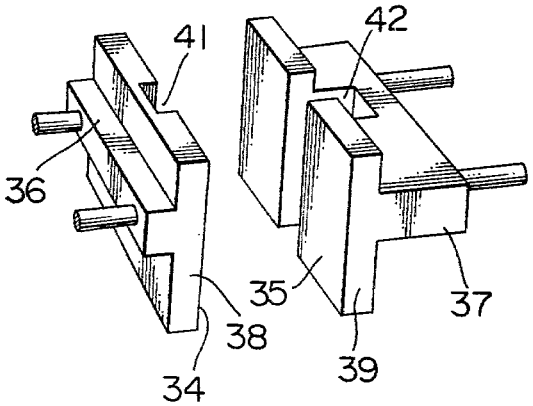
FIG. 7 is a perspective view illustrating digrammatically the gripping plates of the present invention.

The paper sheet supporting plate is positioned horizontally, the binding tape 60 is unwound from the winding drum 61, passed between the rollers 65 and 66, inserted through the tape groove 41 of the gripping plate 38 located below the rollers 65 and 66 engaged with the roller 24 and then wound and stretched on the take-up drum 63 through the tension pulley 67. In this state, a predetermined number of paper sheets 80, for example, bills, are piled and supported on the paper sheet supporting plate 18 between the gripping plates 38 and 39 as shown in FIG. 3. The cam 53 is rotated and the gripping plate 39 is moved toward the gripping plate 38 through the lever 55 and the like to grip the bills 80 between the gripping plates 38 and 39. When the gripping plates 38 and 39 are further moved in this state against the springs 46 and 47 in the same direction, the movement is finally stopped at the point where the groove 42 for the tape application lever 81 is located below the lever 81, as shown in FIG. 4, and the binding tape 60 inserted through the tape groove 41 contacts the end faces of the bills 80 on the side of the gripping plate 38 also as shown in FIG. 4. The upper portion of the binding tape 60 as unwound from winding drum 61 is bent toward the winding drum 61 at the upper left upper corner 93 of the assembly of the bills 80, is allowed to pass above the bills 80 and below the lower end face 83 of the tape application lever 81 and between the rollers 65 and 66. The lower portion of the binding tape 60 in face-to-face contact with the bills 80 is bent toward the roller 24 at the lower left corner 94 of the bill assembly, allowed to pass above the receiving member 79, engaged with the top face of the roller 78, allowed to pass between the rollers 78 and 24, engaged with the lower face of the roller 24 and wound on the take-up drum 63 through the tension pulley 67. In this state, as shown in FIG. 5, the tape application lever 81 is brought down from above the groove 42 and is fitted in the groove while pressing down the binding tape 60 by the lower end face 83. The binding tape 60 as unwound from the winding drum 32 is bent and folded in a U-shaped manner at the lower end face portion 83 and is upwardly extended to pass through the interior of the groove 42 of the projection 37 and between the rollers 65 and 66. In this state, the tape application lever 81 is brought further down, and the upper and lower portions of the binding tape 60 are gripped between the lower end face 85 of the lever 81 and the top end face 96 of the receiving member 79. Approximately, ½ of the lower end face 83 comes into contact with approximately ½ of the top end face 96 to apply the binding tape 60 around the assembly of bills 80. At this point, the upper and lower portions of the binding tape 60 gripped between the tape application lever 81 and receiving member 79 are fusion-bonded to each other by a known bonding device (for example, a high frequency induction melting and cutting device which is not shown) mounted on the receiving member 79, and the bonded portion is cut substantially at the center thereof to complete binding of the bills 80. When the binding tape 60 is thus cut, the tape application lever 81 is lifted up and returned to the original position and the gripping plate 39 separates from the bills 80 and is moved toward the vertical plate 13. The paper sheet supporting plate 18 is turned down about the shaft 20 as the center by rotation of the cam 26 through the engaging lever 31. Accordingly, as shown in FIG. 6, the binding tape 60 unwound from drum 61 engages with the rollers 65 and 66 and with the roller 24 at the upper right corner 95 of the assembly of the bills 80, and it separates from the tension pulley 67 and is wound and stretched on the take-up drum 63. The bound bills 80 are allowed to fall and are then stored. Then, by rotation of the cam 72, the take-up drum 63 is rotated by a predetermined angle in the counterclockwise direction in FIG. 1 through the lever 69, pawl lever 70 and ratchet wheel 71, whereby a predetermined quantity of the binding tape 60 is wound on the drum 63. Then, paper sheets 80 are placed on the paper sheet supporting plate 18 and the above-mentioned operations are repeated to form bound paper sheets in succession.

As will be apparent from the foregoing illustration, in the paper sheet binding apparatus of the present invention, a pair of confronting gripping plates are disposed above a paper sheet supporting plate, a groove for a tape and a groove for a tape application lever are formed on the inner faces of said gripping plates, respectively, paper sheets gripped by both the gripping plates are moved toward the side of the tape application lever to bend a binding tape inserted in the tape groove of the gripping plate in the direction of the thickness of the paper sheets, the binding tape is pressed by the tape application lever to insert the binding tape into the groove for the application lever to surround the paper sheets, and the surrounding end of the tape is bonded to the other side of the tape to effect binding of the paper sheets. By virtue of the above specific structure, in the apparatus of the present invention the left and right sides and upper portion of stacked paper sheets to be bound are kept open while they are gripped between the gripping plates, and the gripping distance between the two gripping plates can be freely set. Therefore, paper sheets can be conveniently bound irrespective of the size and thickness of the sheets. Further, the structure of the binding apparatus is relatively simple and no troublesome operations are required. This allows the operation efficiency to be remarkably increased.

What is claimed is:

1. An apparatus for binding easily foldable paper sheets which comprises:

a paper sheet supporting plate for supporting thereon paper sheets to be bound;

a pair of confronting gripping plates disposed above the paper sheet supporting plate and horizontally movable between one position where the paper sheets are set between said gripping plates and another position resiliently gripping paper sheets therebetween where the paper sheets are bound, each gripping plate being formed on an inner surface thereof with a groove;

means for supplying binding tape to said gripping plates;

means for horizontally moving the gripping plates to resiliently grip paper sheets therebetween while binding tape is received in one groove of one gripping plate between said one gripping plate and the paper sheets to cover paper sheets at top and bottom edges thereof with binding tape;

a tape application lever disposed above the pair of gripping plates and movable vertically to push binding tape into the groove of the other gripping plate between said other gripping plate and the paper sheets whereby the paper sheets are wrapped with binding tape; and bonding and cutting means for bonding wrapping ends of the binding tape and cutting the binding tape to separate a wrapping end of the binding tape from a supplied end of the binding tape.

2. An apparatus as set forth in claim 1, wherein said paper sheet supporting plate is pivotable to downwardly discharge the bound paper sheets.

3. An apparatus as set forth in claim 1 or claim 2, wherein said grooves extend from upper to lower ends of said gripping plates.

4. An apparatus as set forth in claim 1, further comprising means for resiliently biasing a first of said pair of confronting plates towards a second of said plates, said means for horizontally moving the gripping plates, comprising drive means for moving said second of said plates towards said first of said plates so that said means for resiliently biasing is compressed whereby said plates resiliently grip paper sheets therebetween.

5. An apparatus as set forth in claim 4, wherein said tape application lever, in the one position of said plates, is disposed in the vicinity of said first of said plates and, in the another position of said plates, is disposed in the vicinity of said second of said plates.

6. Apparatus as set forth in claim 4 or claim 5, wherein said second of said plates during movement of said plates between said one and said another positions moves paper sheets disposed on said supporting plate toward said first of said plates, and wherein said first of said plates during movement of said plates between said another and said one positions moves the paper sheets toward said second of said plates.

7. Apparatus as set forth in claim 1, wherein said means for horizontally moving comprises first means for moving said plates from said one position to said another position and second means for moving said plates from said another position to said one position.

* * * * *